US005880661A

United States Patent [19]

Davidson et al.

[11] Patent Number: 5,880,661

[45] Date of Patent: Mar. 9, 1999

[54] COMPLEX MAGNETIC FIELD GENERATING DEVICE

[75] Inventors: James G. Davidson; Robert Scarbrough, both of Paris, Tenn.

[73] Assignee: EMF Therapeutics, Inc., Signal Mountain, Tenn.

[21] Appl. No.: 617,667

[22] Filed: Apr. 1, 1996

(Under 37 CFR 1.47)

[51] Int. Cl.[6] ..... H01F 7/02

[52] U.S. Cl. ..... 335/306; 335/302

[58] Field of Search ..... 335/302, 303, 335/306; 434/300, 301; 273/239, 269, 284

[56] References Cited

U.S. PATENT DOCUMENTS

| | | | |
|---|---|---|---|
| 96,044 | 10/1869 | Smith . | |
| 703,989 | 7/1902 | Burry . | |
| 770,433 | 9/1904 | Kinraide . | |
| 781,448 | 1/1905 | McIntyre . | |
| 2,102,790 | 12/1937 | Drollinger . | |
| 3,570,476 | 3/1971 | Gregg . | |
| 3,890,953 | 6/1975 | Kraus et al. . | |
| 3,915,151 | 10/1975 | Kraus . | |
| 4,066,065 | 1/1978 | Kraus . | |
| 4,134,395 | 1/1979 | Davis . | |
| 4,233,965 | 11/1980 | Fairbanks . | |
| 4,303,636 | 12/1981 | Gordon . | |
| 4,402,309 | 9/1983 | Harrison . | |
| 4,622,952 | 11/1986 | Gordon . | |
| 4,626,792 | 12/1986 | Liboff et al. . | |
| 4,765,310 | 8/1988 | Deagle et al. . | |
| 4,818,697 | 4/1989 | Liboff et al. . | |
| 4,838,850 | 6/1989 | Rosengart . | |
| 4,932,951 | 6/1990 | Liboff et al. . | |
| 4,971,562 | 11/1990 | Gleason et al. | 434/301 |
| 5,014,699 | 5/1991 | Pollack et al. . | |
| 5,045,050 | 9/1991 | Liboff et al. . | |
| 5,059,298 | 10/1991 | Liboff et al. . | |
| 5,067,940 | 11/1991 | Liboff et al. . | |
| 5,077,934 | 1/1992 | Liboff et al. . | |
| 5,084,003 | 1/1992 | Susic . | |
| 5,087,336 | 2/1992 | Liboff et al. . | |
| 5,088,976 | 2/1992 | Liboff et al. . | |
| 5,090,423 | 2/1992 | Matsuda et al. . | |
| 5,100,373 | 3/1992 | Liboff et al. . | |
| 5,106,361 | 4/1992 | Liboff et al. . | |
| 5,123,898 | 6/1992 | Liboff et al. . | |
| 5,131,904 | 7/1992 | Markoll . | |
| 5,140,528 | 8/1992 | Swaminathan et al. | 364/508 |
| 5,143,588 | 9/1992 | Liboff et al. . | |
| 5,160,591 | 11/1992 | Liboff et al. . | |
| 5,183,456 | 2/1993 | Liboff et al. . | |
| 5,211,622 | 5/1993 | Liboff et al. . | |
| 5,215,633 | 6/1993 | Liboff et al. . | |
| 5,215,642 | 6/1993 | Liboff et al. . | |

(List continued on next page.)

OTHER PUBLICATIONS

Guterl, Fred; "Beauty and Magnets"; Discover Magazine, Mar. 1997 pp. 38–43.

O'Brien, Jim, "Revolutinary New Magnetic Therapy Kos Arthritis Pain", Your Health Magazine, Apr. 6, 1993, pp. 17–18.

*Primary Examiner*—Lincoln Donovan
*Attorney, Agent, or Firm*—Rick R. Wascher

[57] ABSTRACT

A complex magnetic field generating device, comprising a frame, a plurality of magnets capable of producing a magnetic field, wherein each of the plurality of magnets has a north pole and a south pole and a longitudinal axis passing therethrough, the plurality of magnets are positioned in a side by side axis parallel orientation and are partially held in place by the frame, a coil of electrically conducting material wrapped about the plurality of magnets and orthogonal to the longitudinal axis of each of the plurality of magnets, and a source of electrical energy for supplying an electrical current to the coil enabling a magnetic field detectable with iron filings to be produced therefrom. A switch is provided to enable the electrical current to flow in a first direction and a second direction opposite to the first direction. The plurality of magnets that are positioned in a side by side axis parallel orientation are oriented so that the like poles of the plurality of magnets are positioned adjacent each other.

38 Claims, 13 Drawing Sheets

U.S. PATENT DOCUMENTS 5,224,922 7/1993 Kurtz .
5,267,939 12/1993 Liboff et al. .
5,269,745 12/1993 Liboff et al. .
5,269,746 12/1993 Jacobson .
5,290,409 3/1994 Liboff et al. .
5,312,321 5/1994 Holcomb .
5,312,534 5/1994 Liboff et al. .
5,318,561 6/1994 McLeod et al. .
5,364,536 11/1994 Mercier ..... 210/695
5,366,435 11/1994 Jacobson .
5,368,544 11/1994 Tran et al. .
5,387,176 2/1995 Markoll .
5,437,600 8/1995 Liboff et al. .
5,441,495 8/1995 Liboff et al. .
5,453,073 9/1995 Markoll .
5,458,558 10/1995 Liboff et al. .
5,518,495 5/1996 Kolt .
5,518,496 5/1996 McLeod et al. .
5,658,234 8/1997 Dunlavy .
5,665,049 9/1997 Markoll .
5,669,868 9/1997 Markoll .

SECION A-A

COMPLEX MAGNETIC FIELD GENERATING DEVICE

BACKGROUND OF THE INVENTION

1. Field of the Invention

The present invention relates generally to apparatuses and devices for creating a complex magnetic fields, but more particularly those that have a multi-phase capability. A permanent magnetic field, and a magnetic field created from a current carrying wire overlapping the permanent magnetic field in either an additive or an opposing manner.

2. Description of the Related Art

Magnetism is a property of charge in motion and is related to the electrical theory. Each individual atom of magnetic substance is, in effect, a tiny magnet with a north pole and a south pole. The magnetic polarity of atoms, on the other hand, stem primarily from the spin of electrons about their own axes and is due only partially to their orbital motions around the nucleus.

Magnetic properties of materials may be classified as diamagnetic, paramagnetic, and ferromagnetic. Their classification relates to the manner in which the material reacts in a magnetic field. It is a familiar observation that certain solids such as iron are strongly attracted to magnets. Such materials are called ferromagnetic. Other substances (not necessarily in the solid state) such as oxygen gas and copper sulfate are weakly attracted to magnets. These are called paramagnetic. Still other substances, such as sodium chloride are very feebly repelled by magnets and are called diamagnetic. When heated, ferromagnetic materials eventually lose their magnetic properties. This loss becomes complete above the so-called Curie temperature. While ferromagnetism is exclusively a property of the solid state, all three types of magnetic behavior arise from electrons in atoms.

Magnetism is related to current flowing in a conductor. One of the early discoverers of magnetism and its applications was Nicola Tesla after which the measurement of magnetism (Tesla) was named.

A magnetic field surrounds a conductor through which current travels according to the well known right hand rule. That is, if the thumb of the right hand points in the direction of current flow, the fingers wrap in the direction of the magnetic field. Hence, depending upon the direction of travel, the magnetic field surrounding a conductor may flow either clockwise or counterclockwise when viewed perpendicular to the axis of the conductor through which the current flows.

Magnetism and the application of magnetic fields have been regarded by some as the energy to cure or detect many conditions, ills and maladies of mankind. Such conditions, ills and maladies have been reported to include, but not be limited to, the following: AIDS, cancer, paralysis, inflammation, arthritis, multiple sclerosis, harmful viruses within the body, aging, pain, irregular tissue and bone growth or healing, vision impairments, and many, many other things.

Until now, a device for establishing or otherwise creating a contained complex magnetic field, but more particularly such a device having a three phase capability such that a permanent magnetic field is present to constitute one phase, and a magnetic field created from a current carrying wire overlapping the permanent magnetic field in either an additive or an opposing manner to present a second and third phase, has not been invented.

SUMMARY OF THE INVENTION

The device of the present invention includes a series of substantially cylindrical permanent magnets oriented in a side by side relationship such that the longitudinal axis of each magnet is parallel to the longitudinal axis of an adjacent magent. The poles of the magnets are oriented in a parallel manner such that the magnetic north and south poles of each magnet are next to one another. That is, with exception of the two specified gaps which will be discussed later with respect to the preferred embodiment having oscillating capability, all of the contained magnets are placed field opposing annular orientation. That is, all of their respective north poles and south poles are aligned in the same direction so as not to allow discontinuity within the field's magnetic area.

The plurality of permanent magnets are positioned about the periphery of an elliptical frame preferably having spaced apart halves. Placing these permanent magnets in their respective positions, north to north, and south to south, respectively in a side by side parallel relationship, causes the lines of magnetic flux to be distorted from their normal pattern. The normal pattern is a path originating from the south polar face, radiating toward the north polar face, in a pattern which depicts the laws of magnetic field density, i.e., the density reduces at the rate of an inverse square to the change in distance. A normalized field also depicts the elliptical nature of the lines of force from the polar prospective.

The normalized elliptical field is thus distorted or stretched as a result of the side by side relationship of the individual magnets. This is due primarily to the inability of magnetic field lines to overlap one another. Thus, the respective elliptical fields for each magnet stretch in the plane of their polar alignment. The permanent magnets establish a first phase because of the inherent affinity of the permanent magnets to reach equilibrium, irrespective of the number in the collection or their orientation with respect to one another.

The substantially elliptical shaped frame around which the group of cylindrical magnets are placed is preferably constructed of a non-metallic, non-magnetic material, preferably phenolic composite materials which provide the shaping form or frame for the assembly. Over the outside of this permanent magnet string assembly is wound a coil of enamel coated magnet wire in the preferred embodiment, the type usually involved in electric motor repair functions. The preferred number of coil wire turns may be, for example, one hundred (100), two hundred (200), three hundred (300) or four hundred (400) turns depending upon the embodiment.

Within the coil assembly are a plurality of optional thermal sensors, either resistance or thermocouple type which measure and indicate the coil temperature at various points. The sensors may also be used to monitor power levels in the coil, and magnetic energy transfer.

A preferred power supply is connected to the coil of the device and consists of an isolation transformer configured in such a manner as to provide electrical isolation from the power source by means of a 1:1 magnetic coupling circuit. This isolated supply is then fed to an auto-transformer. Being a voltage regulating device, which allows a variable supply of voltage and allows current to be fed into a full-wave rectifier set, it converts the applied alternating current to a direct current with a resulting ripple frequency of 120 pulses per second. Because of the combination of the pulsating power supply and the inherent inductance and hystersis of the coil, the only time the coil goes to residual field magnetism is in the total absence of any applied electric current.

By passing the output through a double pole double throw ("DPDT") switch assembly, reversal of the applied current, and thus the generated field, can be changed by the operator. Further, the addition of a steering switch, directing current through either one or both coils allows flexibility in field contacts.

Thus, in one embodiment the field coils are wound in such a way as to create two (2) separate coils, allowing finer control on the total field energies which are determined by the number of turns within the coil, the current through the coil, the permeability of the medium within the coil area, as well as to a lesser degree, coil temperature and distances between coil and its magnetic focal point. In alternate embodiments, a single coil with the appropriate number of turns is used.

As current is caused to flow through the coil conductors, depending on the polarity of the current and its resulting flow direction, the complex magnetic field produced can be either additive to the existing polar magnetic field, or it can be caused to create a field in the opposite direction to the fixed field. The additive orientation refers to the magnetic field from the coil augmenting the magnetic field associated with the permanent magnets and may be construed as the second phase of the device. Similarly, the opposing orientation refers to the magnetic field from the coil having magnetic fields lines traveling in a direction opposite to the magnetic field lines associated with the permanent magnets. This opposing orientation is referred to as the third phase of the device. Like the first phase, the second and third phases of the device may be used to produce iron filing sculptures. The iron filing sculptures of the second phase reveal a tendency of the iron filings to travel toward the center of the elliptical shape to form a starlike pattern. The iron filing sculpture of the third phase of the device shows a tendency of the iron filings to move outward from the interior of the elliptical shape and thus produce yet another unique sculpture. The iron filing sculptures produced by the first phase of the device are visually different from those of the second and third phases. The iron filing sculptures produced by the second phase of the device are visually different from those of the first and third phases. The iron filing sculptures produced by the third phase of the device are visually different from those of the first and second phases.

Physically, if the applied field is in the same direction as the permanent field it enhances the total field density, increasing the total lines/$Cm^2$ density resulting in more magnetic energy being available within the center of the elliptical area. As the field current increases the resulting field density changes proportionally. As indicated below, the flux or lines of magnetic energy radiate from the coil area toward the center in a classic pole to pole elliptical manner. Each line, as illustrated, begins at the south polar region and travels to the north polar area as it completes its own particular magnetic circuit.

Conversely, if the field coil windings are reversed, the created field is opposing the permanent field direction. As the current is increased to the coil windings, the existing magnetic energy is overpowered by the imposed electric field and the magnetic media then serves as a field focal point for the induced field. This results in extreme distortion of the fields, both the existing permanent, and the introduced complex magnetic fields.

Thus, the resulting fields of energy are distorted from their usual elliptical pattern to one of more elongated from the pole faces resulting in further chaos, and a change in the attraction forces within the loop. Instead of being drawn to the center of the loop, the energy concentrates along the magnetic center of the pole faces.

In the preferred embodiment of the invention, at least one magnet is removed from the permanent magnet string to create a gap in the string. Preferably three magnets are removed. The first is removed from a region near the horizontal axis of the elliptical shape frame and the other two are removed from a location approximately twelve degrees north (above) the first gap as measured from a common reference point. The existence of the gaps alter the appearance of the first, second and third phases, but the alterations can be generally referred to be within the same nature or family of phases as the first, second and third phases.

For simplicity, the phases and their permutations shall be referred to herein as the first, second or third phases throughout the text and the names for each shall be generally associated with the resultant magnetic field lines and their permutations. That is, the first phase is the magnetic field of the permanent magnets by themselves, the second phase can be generally referred to as the permanent magnetic field lines and the magnetic field lines from the energized coil in an additive orientation as described above, and the third phase shall be generally referred to as the permanent magnetic field lines and the magnetic field lines from the energized coil in an opposing orientation as described above.

The utility of the inventive device is speculated to be too vast and unknown, even though any and all of such utilitarian features, functions, advantages, and capabilities, iron filing sculptures or the unknown, are expressly considered to be part of the present invention even though not specifically set forth herein.

With respect to the gaps, this is the source of a physical area of distortion within the field. Physically leaving out magnets during the assembly process, replacing them with non-magnetic material or simply forming an air space creates the distortion and permutations of the three phases of the device. These create anomalies in the field by introducing an area of relatively little or no inductance, allowing the relative field current velocity to increase then decrease abruptly because of the changes in circuit reluctance.

It is believed that a ripple is introduced within the relative field in intensity, pattern, energy and other characteristics, as the velocity of the field slows to its original speed, momentarily re-establishing its characteristics, only to be upset again by a second gap.

Thus, this particular system of devices can be summarized as consisting of an elliptical ring containing a group of permanent magnets, placed in a consistent north-to-north pole configuration, about the circumference of the ring, with on over-winding of electrical insulated wire, forming an electromagnet, whose field is concentrated by the group of permanent magnets. By controlling the polarity and intensity of the fields, they provide a variety of magnetic phases.

The inventions may also be summarized in a variety of ways, one of which is the following: A complex magnetic field generating device, comprising: a frame; a plurality of magnets, wherein each of the plurality of magnets has a north pole and a south pole and a longitudinal axis passing therethrough, the plurality of magnets are positioned in a side by side axis parallel orientation and are partially held in place by the frame; a coil of electrically conducting material wrapped about the plurality of magnets and orthogonal to the longitudinal axis of each of the plurality of magnets; and a source of electrical energy for supplying an electrical current to the coil enabling a magnetic field to be produced therefrom.

The present invention may also be summarized as follows: a complex magnetic field generating device, comprising: a plurality of magnets capable of producing a magnetic field, wherein each of the plurality of magnets has a north pole and a south pole and a longitudinal axis passing therethrough, frame means for holding the plurality of magnets in a side by side axis parallel orientation; a coil of electrically conducting material wrapped about the plurality of magnets and orthogonal to the longitudinal axis of each of the plurality of magnets; and a source of electrical energy for supplying an electrical current to the coil enabling a electromagnetic field to be produced therefrom.

The present invention may also be summarized as follows: a complex magnetic field generating device, comprising: a frame; a plurality of magnets capable of producing a magnetic field, wherein each of the plurality of magnets has a north pole and a south pole and a longitudinal axis passing therethrough, the plurality of magnets are positioned in a side by side axis parallel orientation and are partially held in place by the frame; a source of electrical energy for supplying an electrical current; and coil means of electrically conducting material wrapped about the plurality of magnets and orthogonal to the longitudinal axis of each of the plurality of magnets for establishing a magnetic field to be produced therefrom.

A switch to enable the electrical current to flow in a first direction and a second direction opposite to the first direction. The plurality of magnets that are positioned in a side by side axis parallel orientation are oriented so that the like poles of the plurality of magnets are positioned adjacent each other. The plurality of magnets that are positioned in a side by side axis parallel orientation are oriented so that the like poles of a majority of the plurality of magnets are positioned adjacent each other.

The frame or frame means may further comprise a substantially elliptical frame. The coil of electrically conducting material wrapped about the plurality of magnets and orthogonal to the longitudinal axis of each of the plurality of magnets, further comprise a plurality of coils. The frame or frame means can comprise a plurality of spaced apart frame portions. It is constructed of a non-metallic material.

A cover may be removably attached to the frame to shield the coil. The cover and frame or frame means comprises a cooperating cover and frame sized to establish a passage between the coil and the cover. At least one duct is present to enable gaseous flow into and out of the passage from a location outside of the passage. The switch is a double pole double throw switch, and the plurality of magnets form a continuous uninterrupted belt of magnets. The plurality of magnets can form a belt of magnets having at least one gap in the belt.

It is a primary object of the present invention to provide a device capable of achieving a variety of things, useful objects, features, and advantages including the production of iron filing sculptures.

DETAILED DESCRIPTION OF THE PREFERRED EMBODIMENT(S)

Figure 1:
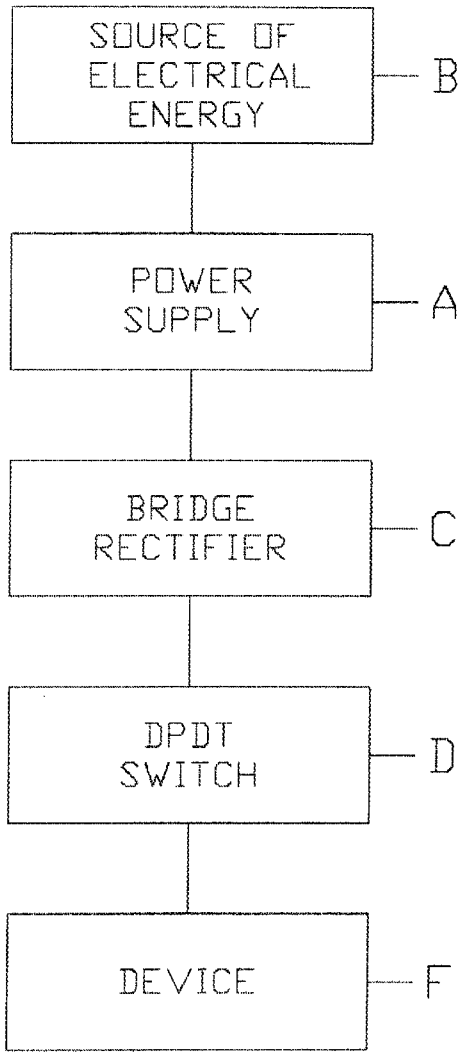
FIG. 1 is a schematic block diagram of the electrical components of the present invention.

With reference to the schematic diagram designated as FIG. 1, the power supply designated generally by the reference letter A consists of an isolation transformer of suitable capacity, offering an electrical isolation due to the nature of the magnetic coupling characteristics of such a device. This is attached to a convenient source of commercial power B. This is then input into a full wave bridge rectifier C of suitable ratings for both voltage and current. The output of this full wave bridge rectifier C would then have the characteristics of being a ripple output of direct current characteristics, with the ripple frequency being exactly twice that of the input frequency. This direct current is then output through a switch configuration D, providing a means of conveniently reversing the flow direction of the applied electric energy and ultimately the induced complex magnetic field polarity.

Figures 2, 3, 4:
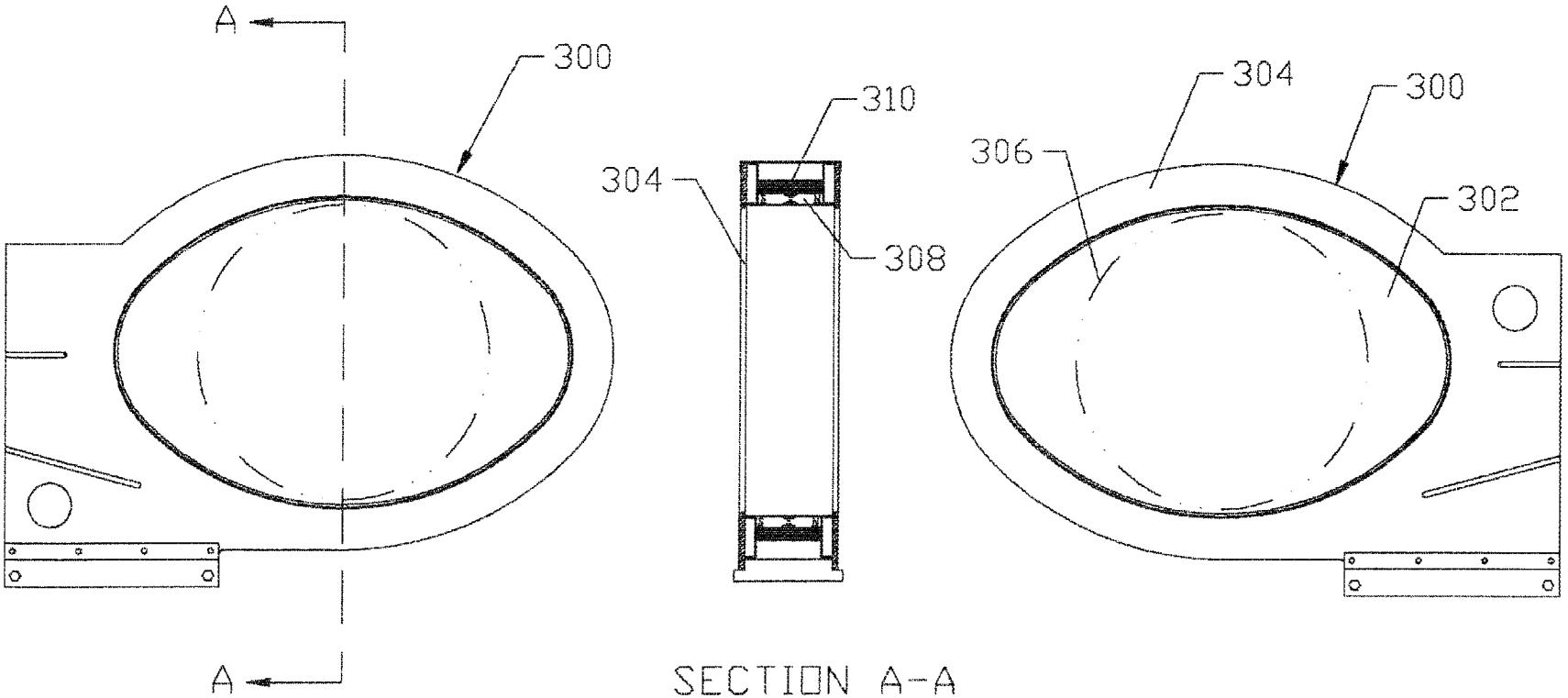
FIGS. 2 and 3 are a front view and back view respectively of an embodiment of a coil component of the present invention.
FIG. 4 is an end view of the complex magnetic source component shown in FIGS. 2 and 3.
Figures 5, 6, 7:
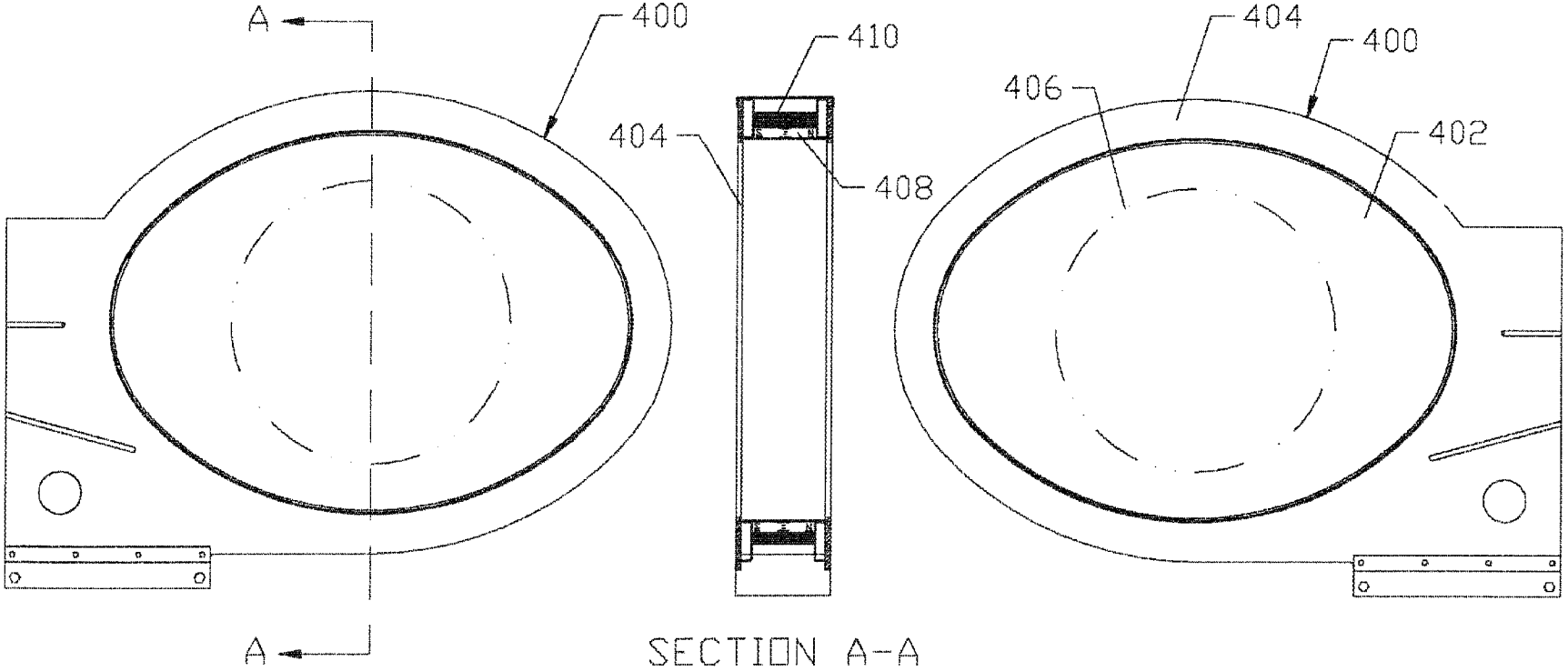
FIGS. 5 and 6 are front and back views of an alternate embodiment of the present invention.
FIG. 7 is an end view of the alternate embodiments of the complex magnetic source component of the present invention shown in FIGS. 5 and 6.

With reference to FIGS. 2–8, preferred geometries of the present invention (F in FIG. 1) are illustrated. FIGS. 2–4 show a "small" device designated generally by the reference numeral 300. FIGS. 5–7 show a "large" device designated generally by the reference numeral 400. In each embodiment 300 and 400 of the device as shown in FIGS. 2–7, a central passageway 302 and 402, respectively, is formed inside of the device frame 304 and 404.

As illustrated by the circles 306 and 406, which are of identical size, the relative dimension of the small device 300 is visible with respect to the larger dimension of the larger device 400. With respect to the side or end views of the device (FIGS. 4 and 7), substantially the same geometry is utilized for both devices or the "profile" may be modified in accordance with the teaching set forth herein and below. That is, magnets 308 and 408 are positioned annularly around the surface of the device frame 300 and 400. A coil winding 310 and 410 overlies the annular belt of magnets 408.

Figure 8:
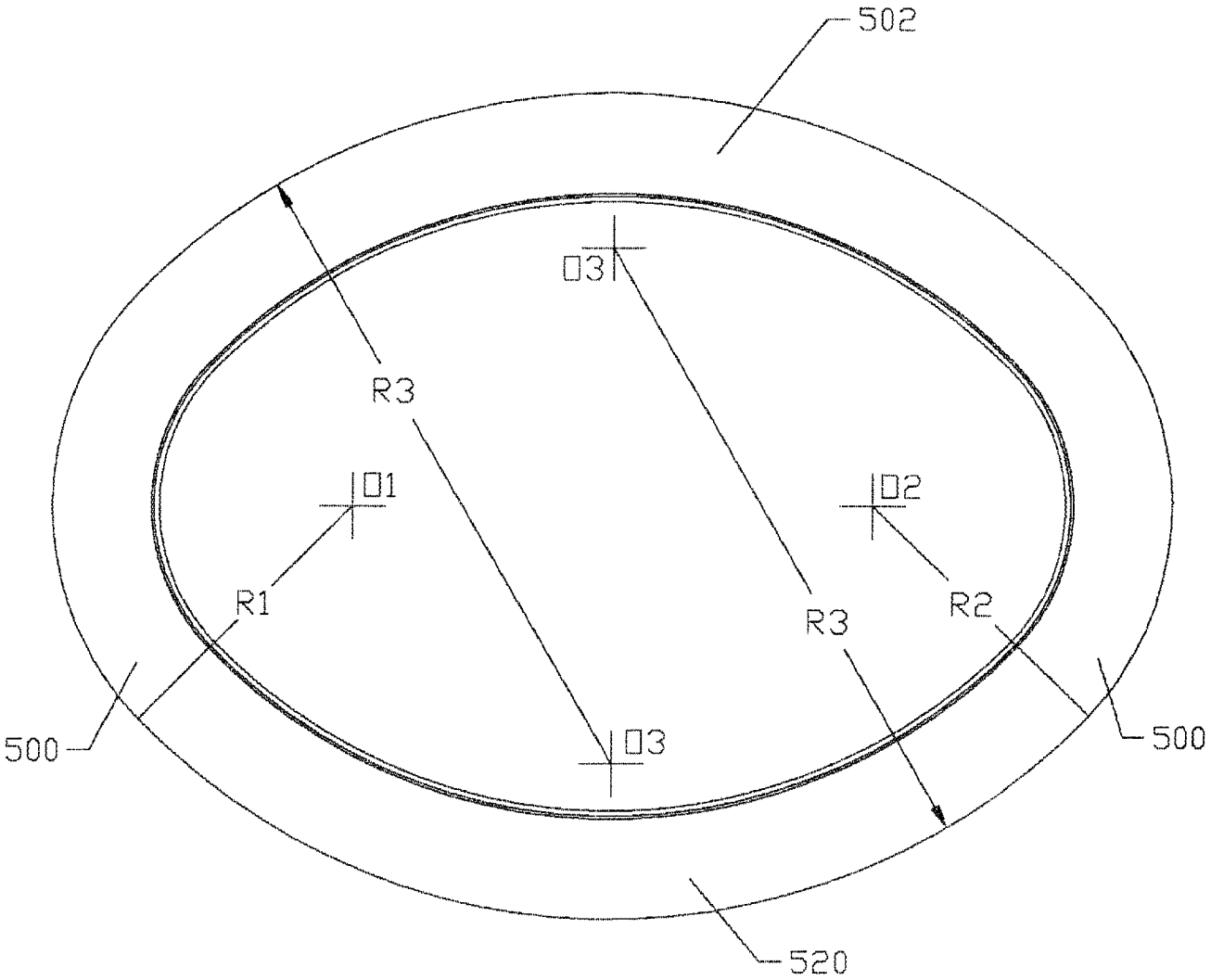
FIG. 8 is a side view of the geometrical construction of an embodiment of the preferred substantially oval or elliptical shape of the present invention.
Figure 10:
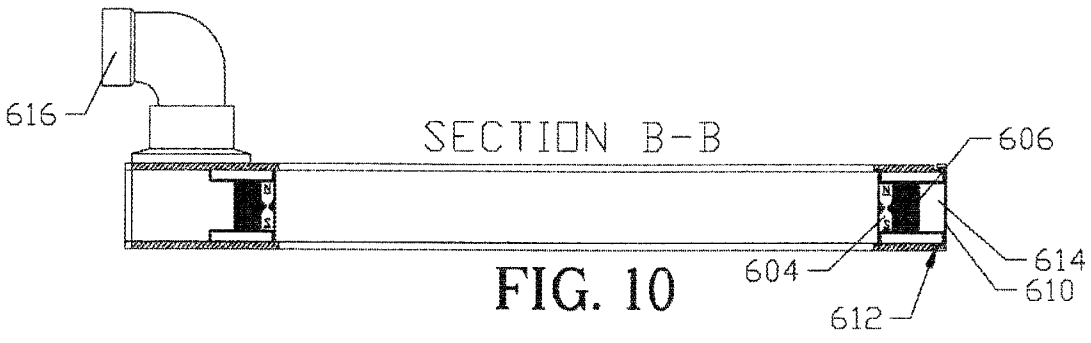
FIG. 10 is a top view of the present invention shown in FIG. 9.
Figure 11:
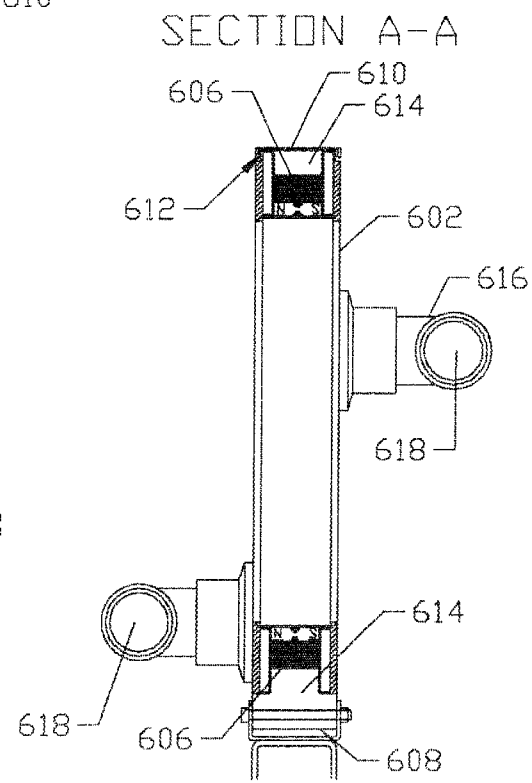
FIG. 11 is a side view of the present invention shown in FIG. 9.
Figure 9:
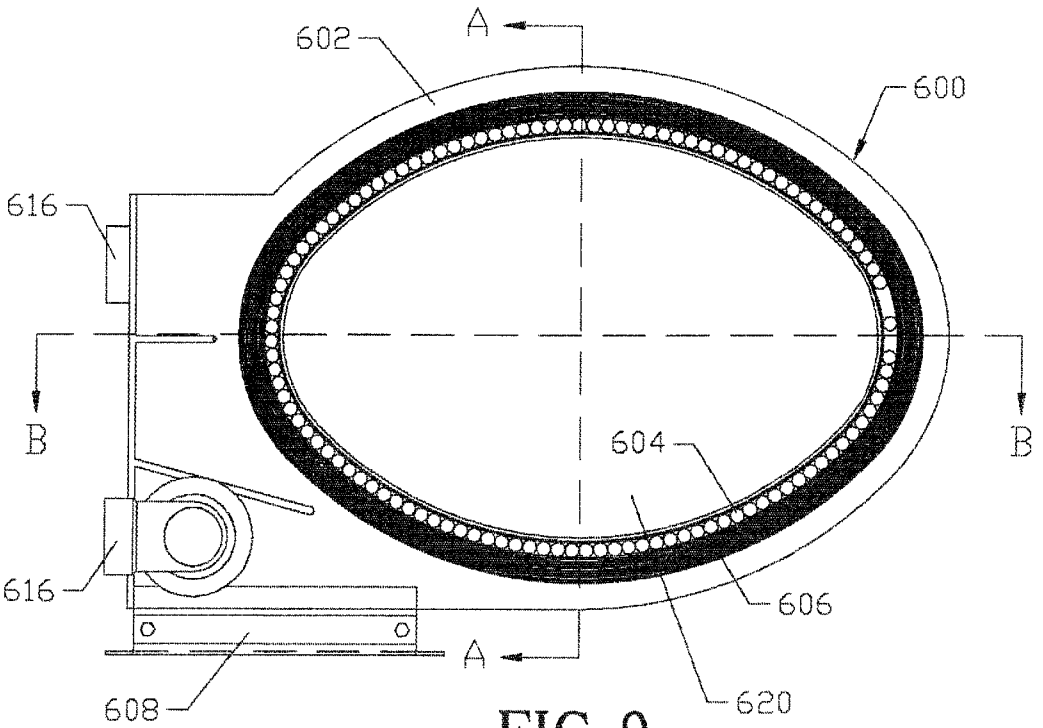
FIG. 9 is a front view of an alternate embodiment of the present invention having air flow ducts associated therewith.

With respect to FIG. 8, the substantially oval construction of the device 300 and 400 includes the elements of a geometric ellipse. Origin 1 and origin 2 designated generally by O1 and O2 are the low side of the ellipse. Therefore, O1 and O2 have a designated radii R1 and R2 which sweep through an arc of approximately 90 degree to form the sides of the ellipse. Origin O3 presents a radii R3 to form the top and bottom components of the device. Origin O4 being the centroid of the ellipse also presents a definable radii R4 which is definable for both the top and bottom interior portions of the device. That is, each device consists of end portions 500 as defined by the arc produced by R1 and R2, conjoined with top and bottom portions 502 as defined by the radii O3 or O4 depending upon the frame of reference.

Of course, there are several radii as indicated in the figure but not given reference numerals as they are associated with interior surfaces, magnet layer surfaces as measured at the centroid of the magnet components of the present invention and radii associated with the device in addition to the device frame.

Figure 12:
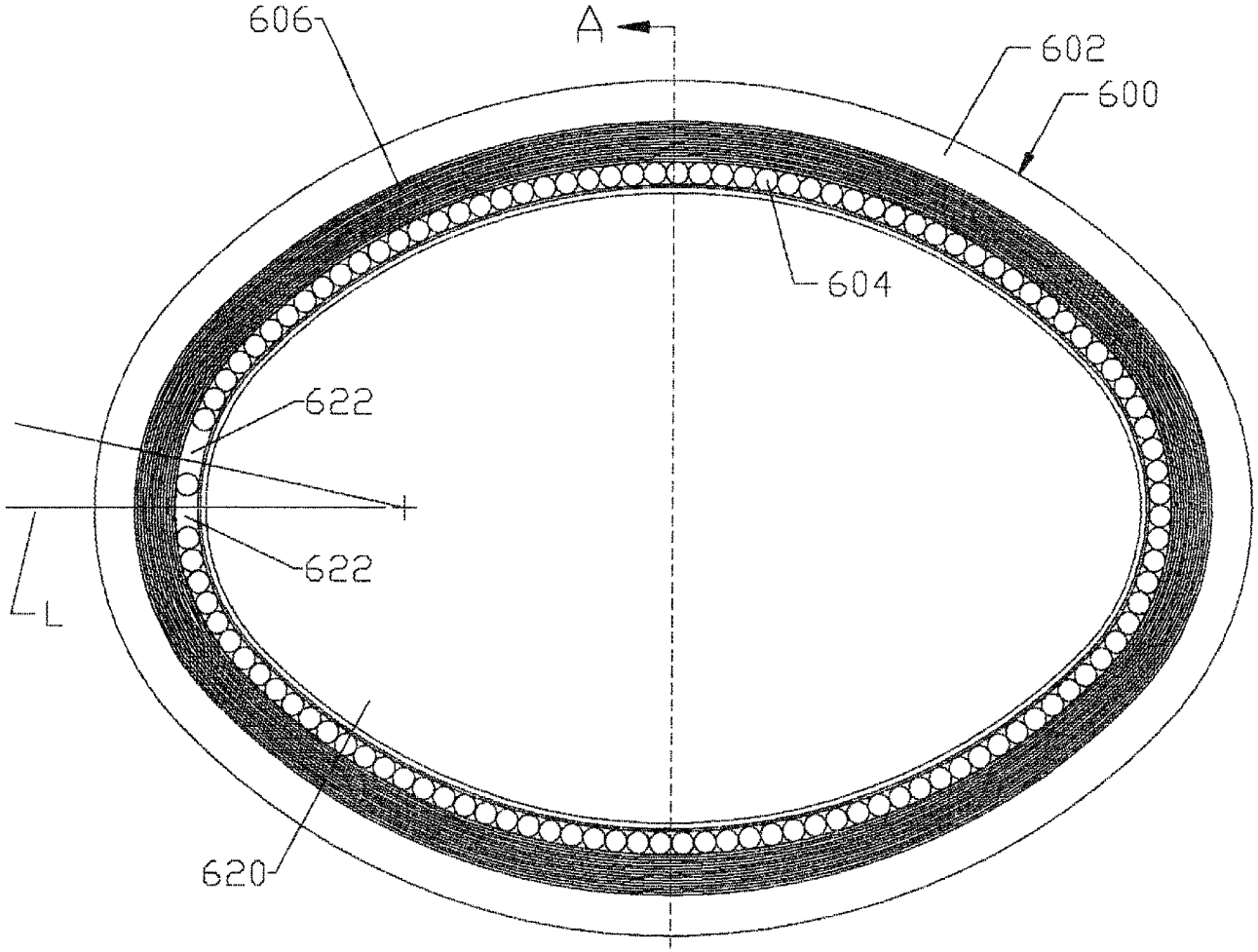
FIG. 12 is an illustration of the relative orientation of the magnetic components and coil component of the preferred embodiments of the present invention.

Accordingly, with reference to FIGS. 9–13, an embodiment of the device component of the present invention is designated generally by the reference number 600 in such a manner that the device frame 602 has been partially removed from the device 600 shown in FIG. 12. Specifically, with reference to FIGS. 9, 10 and 11, device 600 is comprised of an annular ring or belt of magnets 604 having a substantially cylindrical configuration and positioned with their poles oriented in a parallel manner such that any two magnets adjacent to one another have aligned north and south poles as indicated by their cylindrical length.

A coil winding 606 overlies the belted or annular layer of magnets 604. A bracket 608 enables the device frame 602 to be easily attached to any one of the bed geometries described above. Within the coil assembly are a plurality of thermal sensors, either resistance or thermocouple type which measure and indicate the coil temperature at various points. The preferred sensors are manufactured by Honeywell/Microswitch, Inc. and have model no. SS94A2. The sensors are used to monitor power levels in the coil and magnetic energy transfer.

Cover 610 preferably includes a cooperating tongue and groove snap connection 612 so that the cover may be removed to service the interior magnetic and coil components of the device. As such, the existence of the cover attached to the device frame 602 and the disposition of the magnet and coil establish an air space 614 between the coil 606 and cover 610. The air space 614 provides a means of convective heat transfer such that if an air flow in the air space 614 were induced or created, the flow of air would have a tendency to cool the coil 606 and magnets 604 when they become heated after the coil 606 in energized in the manner described below.

Air ducts 616 are provided to establish a positive air flow within the air space 614. Either air duct 616 may be utilized as the means of ingress or egress depending upon the desired efficiency of the extraction of the heat within the air space 614. That is, air ducts 616 have an interior flow channel 618 to which a supply of forced air (not shown) or other coolant in gaseous form may be introduced and expelled from the air space 614 during operation of the device 600.

Figure 13:
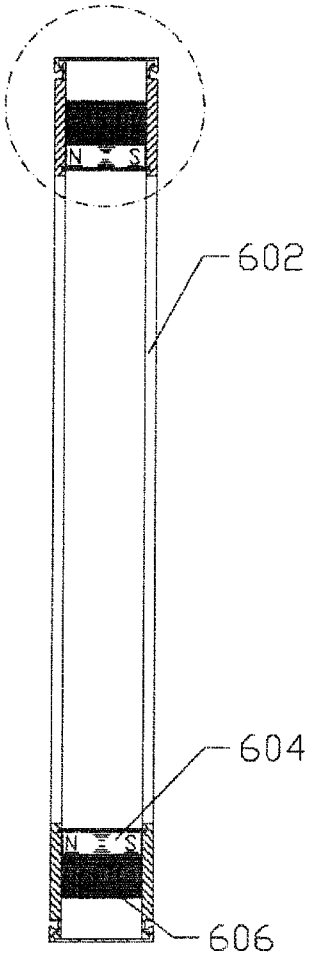
FIG. 13 is a cross-sectional view taken along line A—A of FIG. 12.

With reference to FIGS. 12 and 13, the orientation of the coil 606 and the magnets 604 is readily observed. Cross-section line A—A, which also serves as a vertical axis and horizontal line L, which serves as a horizontal axis, define the centroid of the interior channel 620 of the device. As shown in FIG. 12, there are a pair of gaps 622 in the annular layer or belt of magnets 604. The gaps are provided so as to establish an oscillating or pulsating magnetic field within the open channel 620 of the device 600.

In either case, where current flows through the coil 606 and pursuant to the right-hand rule establishes field lines in either a forward or reverse direction, its additive or subtractive affect with respect to the permanent magnetic field, as will be described more thoroughly below, is interrupted by the gaps 622 in the layer of magnets 604.

Figure 14:
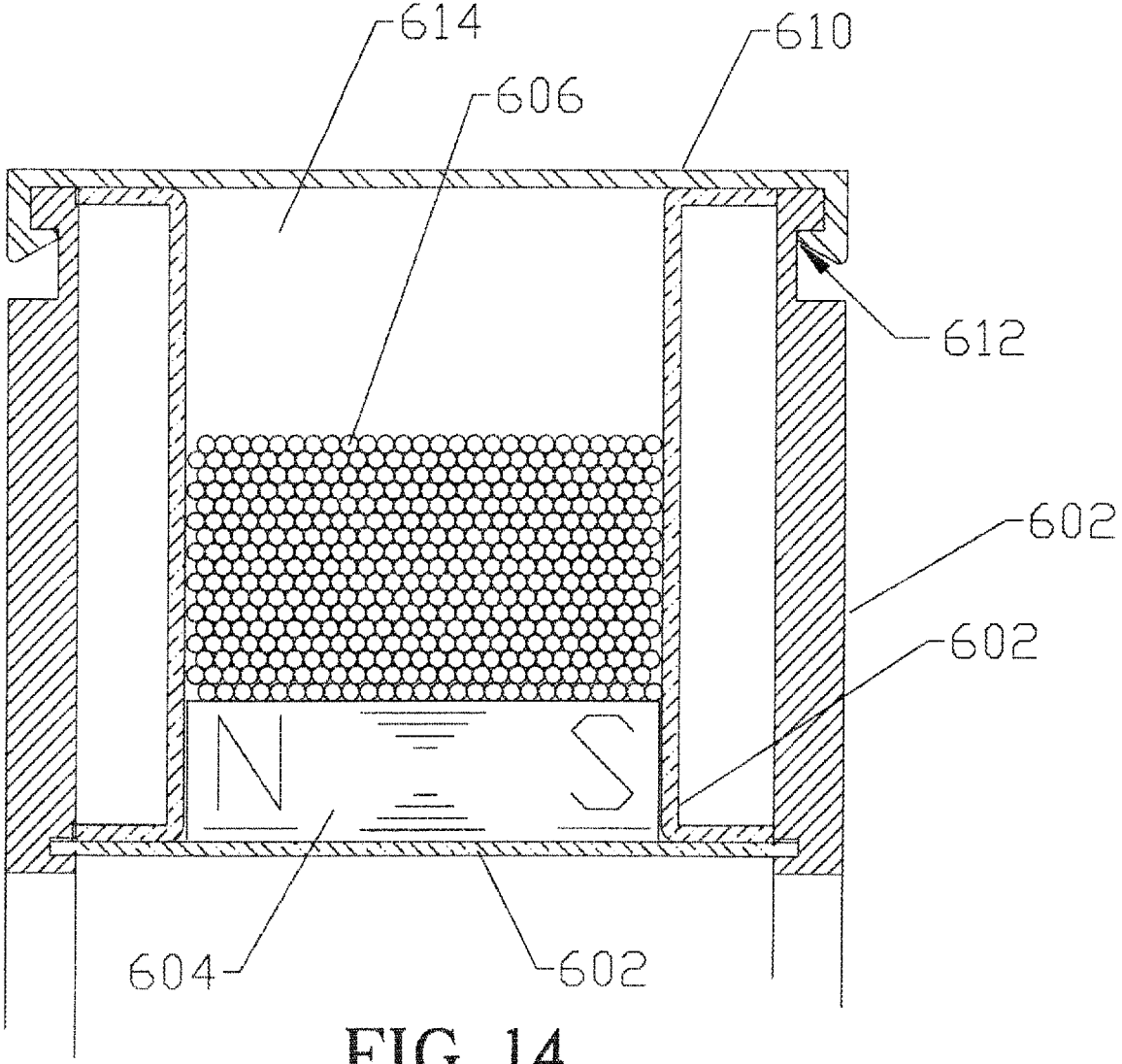
FIG. 14 is an enlarged side view of the circled portion of FIG. 13 and further including a cover component.

With reference to FIGS. 14–17, alternate profiles of the device configuration, namely, the magnet 604 and coil winding 606 orientation with respect to one another is illustrated. For clarity, each small circle 606 is a cross-sectional view of a continuous strand of coil as it is wrapped about the device. Similarly, magnet 604 is substantially cylindrical having ends as shown in FIG. 12 and a length as shown in FIG. 14.

Figure 17:
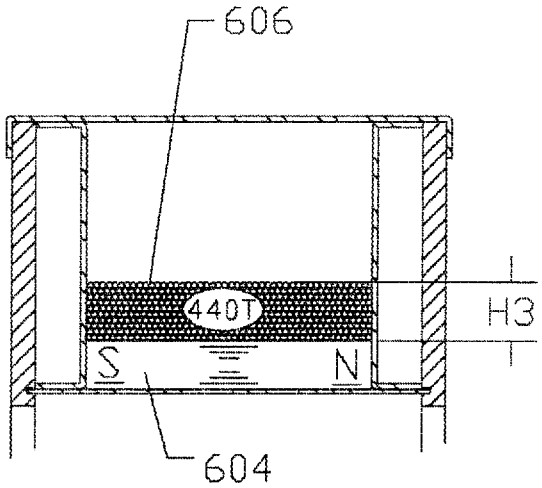
FIGS. 15–17 are alternate embodiments of the geometry of the present invention shown in FIG. 14 and illustrating a variety of profiles.
Figure 16:
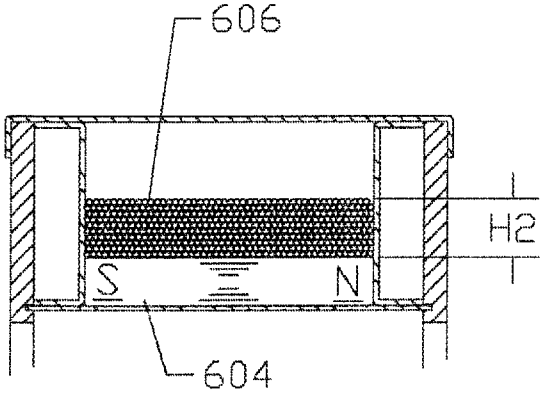
Figure 15:
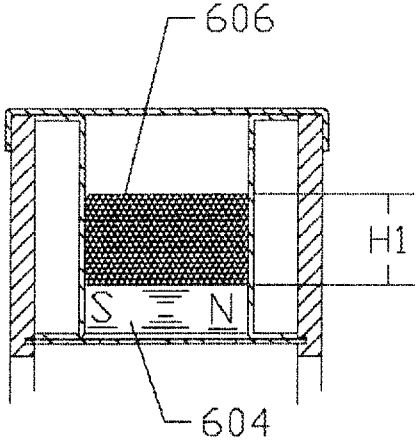
Figure 18:
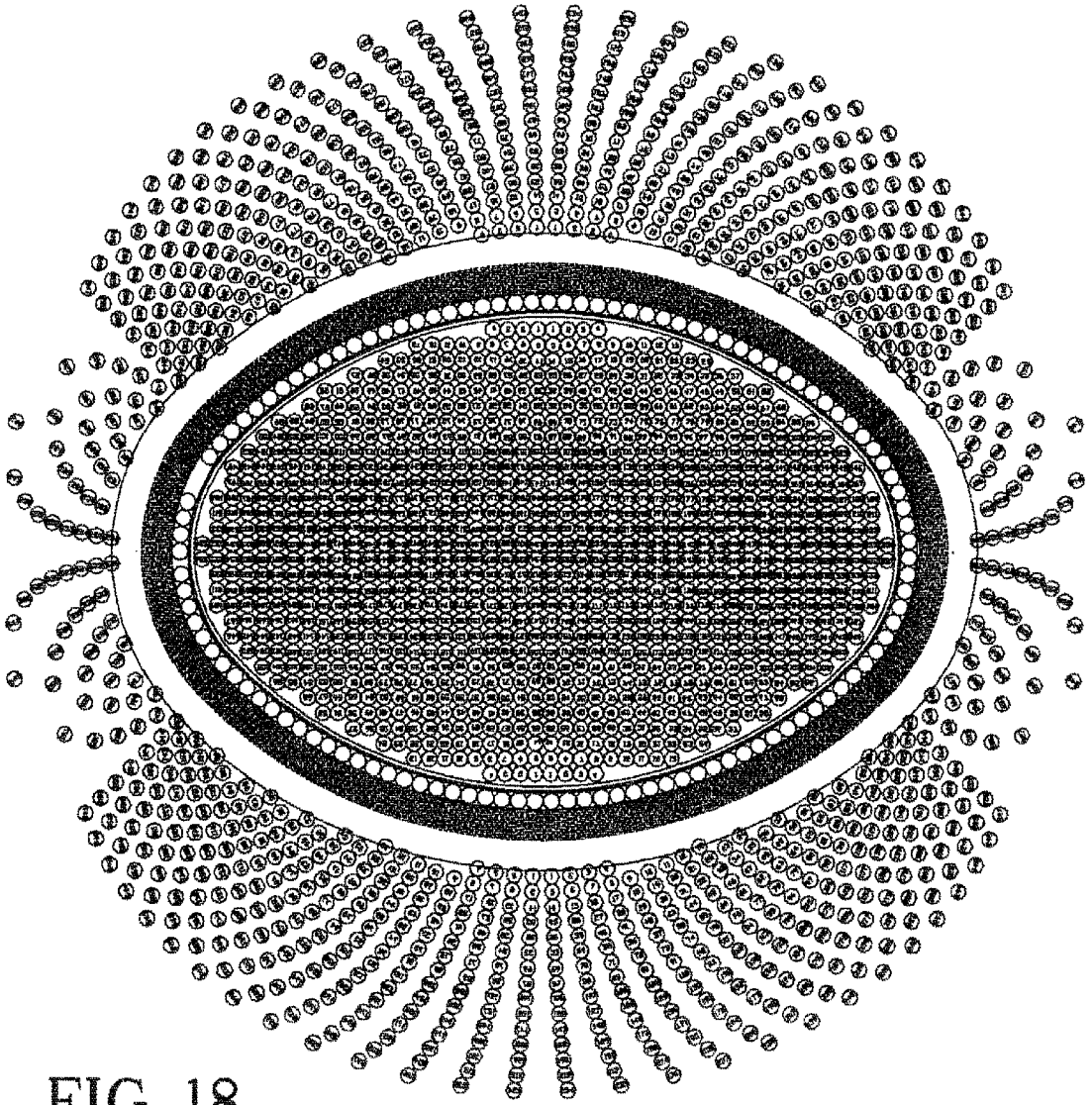
FIG. 18 is a graphical representation of the magnetic field flux lines associated with the permanent magnets of the present invention.
Figure 19:
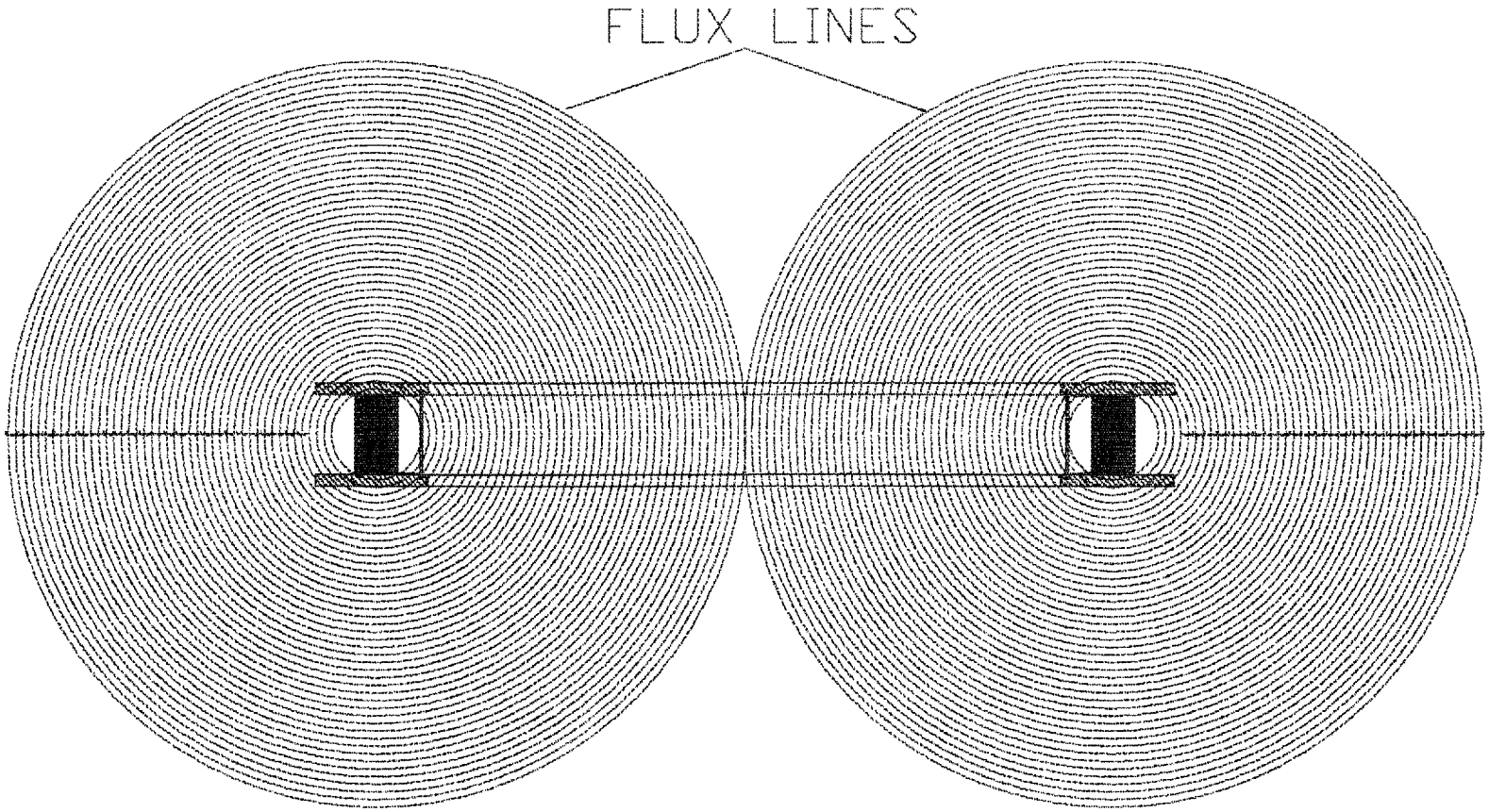
FIG. 19 is a graphical illustration of the magnetic flux lines associated with the coil component of the present invention.

As shown in FIGS. 15–17, the cross-sectional profile of the magnet and coil winding may be modified to several alternate constructions. Focusing solely on the magnet and coil components of the cross-sectional view, it is shown that coil 606 of FIGS. 15–17 may have a varying proportional height H1, H2 and H3, respectively, of FIGS. 15–17. Similarly, magnets 604 may experience a change in dimension but considering the structure of magnets of this type, the strength level of the magnet may simply be varied in accordance with the size.

The magnets shown in FIG. 15 are smaller that those shown in FIG. 16 and FIG. 17; however, in the preferred embodiment of the present invention, the strength or power level of the magnets 604 are identical despite their differing geometry as illustrated in the figures. In such event, each cross-sectional profile shown in FIGS. 15–17 will produce substantially the same characteristics or may exhibit different characteristics depending upon the component selection.

A MODE OF OPERATION

Figure 20:
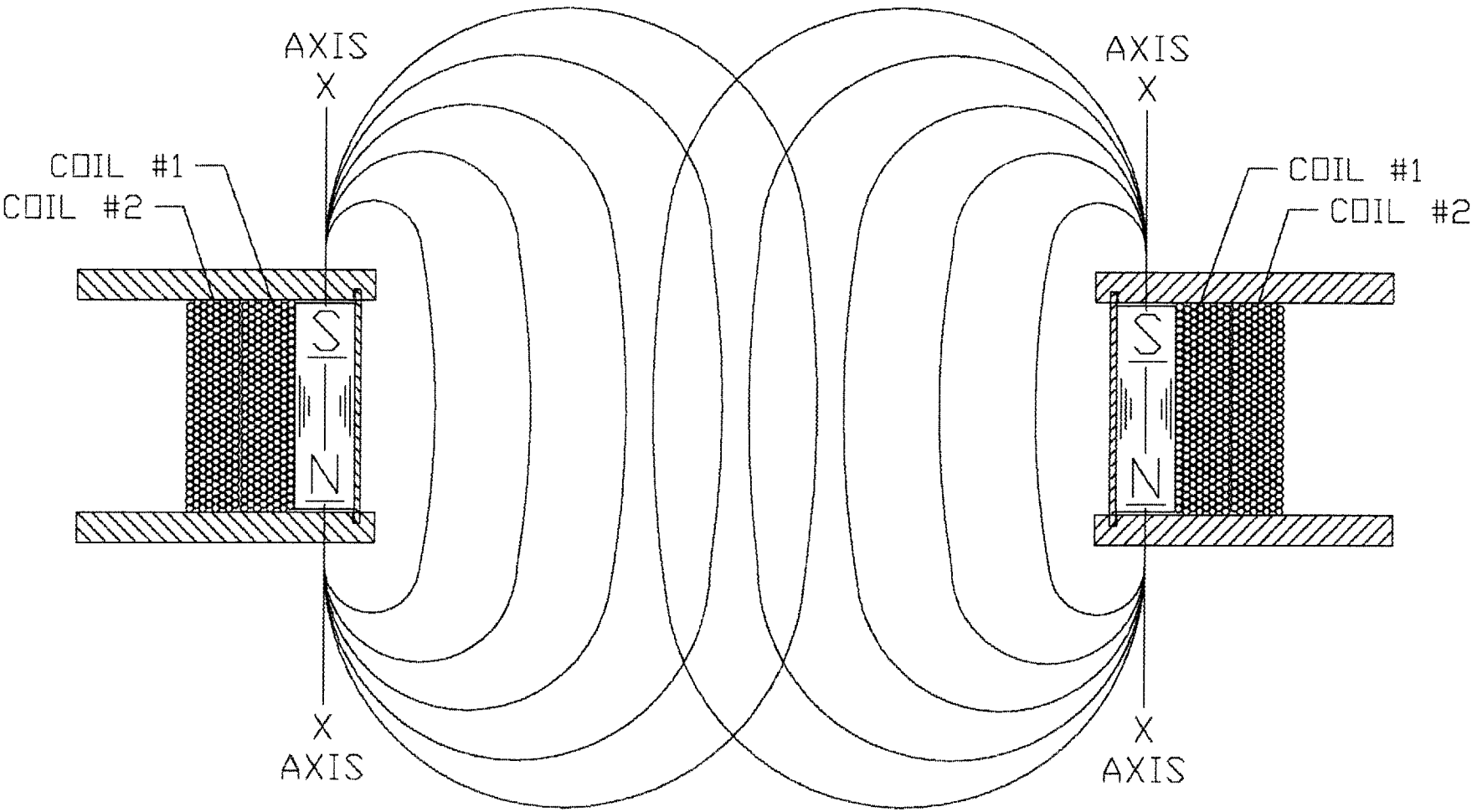
FIG. 20 is an illustration of the permanent magnetic field associated with the field lines of FIG. 18 and further illustrating a longitudinal axis for each magnet.
Figure 21:
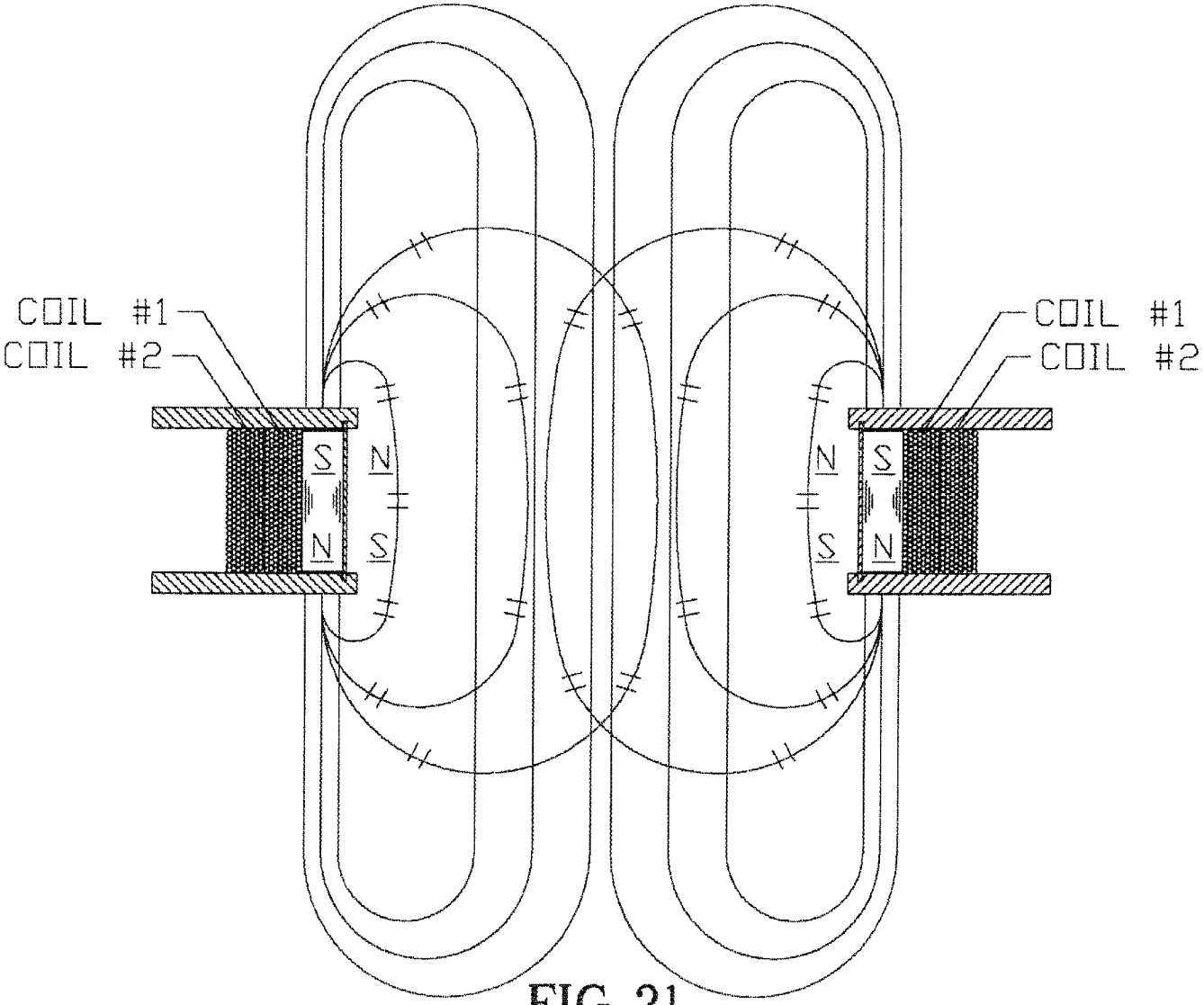
FIG. 21 is a graphic representation of the superimposed field lines associated with FIGS. 19 and 20.
Figure 22:
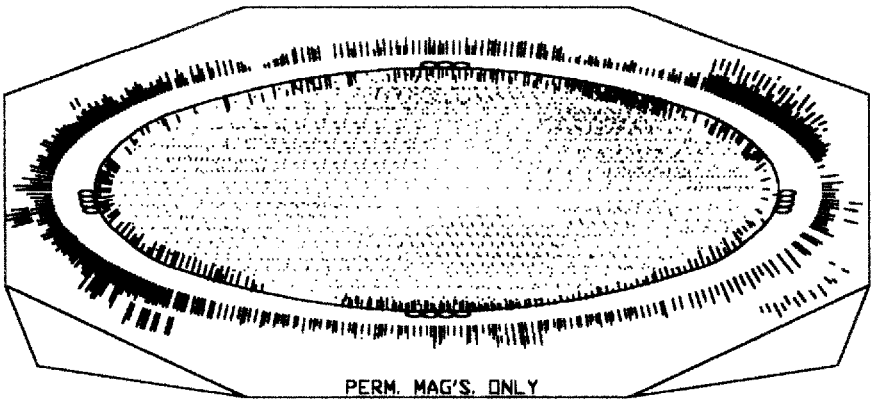
FIG. 22 is copy of an actual iron filing sculpture produced by phase one or the first phase of the device.
Figure 24:
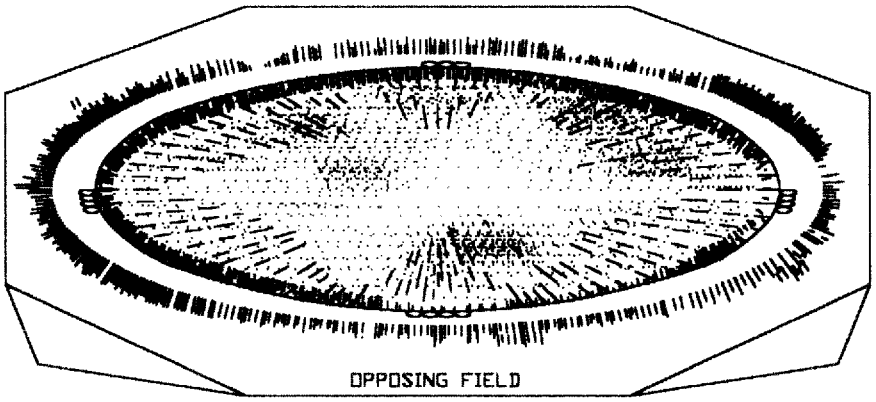
FIG. 24 is copy of an actual iron filing sculpture produced by phase three or the third phase of the device.
Figure 23:
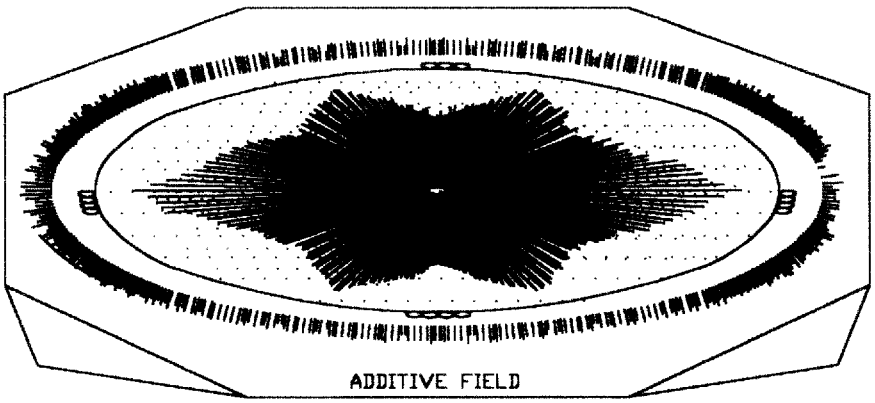
FIG. 23 is copy of an actual iron filing sculpture produced by phase two or the second phase of the device.

With reference to FIGS. 18–21, and sculpture FIGS. 22–24, the flux lines of the magnetic fields associated with the permanent magnets of the device component of the present invention (FIGS. 20 and 22); the flux lines associated with the magnetic field attributable to energizing the coil or coil 606 (FIG. 19); and the additive affect of the field lines attributable to both the permanent magnets 604 and the coil 606 (FIGS. 21, 23 and 24) are all shown. While FIGS. 18–21 may be an oversimplification of the actual magnetic field within the internal planar area of the passageway of the substantially oval ellipse of the device defined by the device frame, such is a starting point for mapping the magnetic field. Such mapping is not particularly simple in that the pulsating or modulated magnetic field established by the gaps in the belt or annular orientation of the magnets creates complex fluctuations in the magnetic field within the planar area of the device. As shown in FIG. 20, each of the plurality of magnets have a longitudinal axis X passing through both polar regions of the magnet.

As shown, the fields of magnetic energy are distorted so that they do not travel in a normal pattern from the south pole to the respective north pole area, in the established elliptical pattern. The lines of flux from the permanent magnets continue to travel in their respective patterns, while the superimposed complex magnetic lines are distorted in such a manner as to force them out away from the ring face, in an elongated pattern which results in the loss of some of the field energy, being dissipated in the form of hysteresis losses, due to the relatively low permeability of the surrounding air.

This energy is further supplemented by the introduction of two or more gaps within the magnetic field area. As the electric current is applied to the conductor it produces a resulting magnetic field by its very nature. Owing to this fact, is the notion that within an inductive circuit that the current has a tendency to slow down due to induced counter electromotive forces of the surroundings that when the current flow reaches an area of much lower reluctance that the current would have a tendency to accelerate. Upon being reintroduced to an area of high inductance the collective energy would tend to cause an upset in the proximity of the gap in the field. This energy would cause an energy burst to be introduced into the entire energy field, resulting in a sort of agitation of the field's energy patterns. By introducing a subsequent gap in the field, a mathematical triangulation will then allow the focusing of energy and its resulting upsets to within a specific targetable area.

The resultant iron filing sculptures are shown in the photographs of FIGS. 22–24. FIG. 22 depicts the type of sculptures produced by the first phase of the device as indicated in the Figure with the notation "PERM. MAGS ONLY". FIG. 23 depicts the type of sculptures produced by the second phase of the device as indicated in the Figure with the notation "ADDITIVE FIELD". FIG. 24 depicts the type of sculptures produced by the third phase of the device as indicated in the Figure with the notation "OPPOSING FIELD".

What is claimed is:

1. A complex magnetic field generating device, comprising:

a frame having spaced apart sides and an interior channel;

a plurality of magnets capable of producing a magnetic field comprised of a plurality of lines of magnetic flux, wherein each of the plurality of magnets has a north pole and a south pole wherein the flux lines extend and communicate therebetween, and a longitudinal axis passing through both the north pole and the south pole;

the plurality of magnets are positioned in a side by side orientation and are partially held in place by the frame such that the longitudinal axes of the plurality of magnets are parallel with one another;

a length of electrically conducting wire wound about the frame to overlie the interior channel of the frame to form a coil in a direction generally perpendicular to the longitudinal axis of each of the plurality of magnets;

a source of electrical energy for supplying an electrical current to the coil enabling a magnetic field comprised of a plurality of circular magnetic flux lines surrounding the wire to be produced therefrom; and the circular lines of magnetic flux associated with the coil are generally parallel to the lines of magnetic flux associated with each of the plurality of magnets.

2. The device of claim 1, further comprising:

a switch to enable the electrical current to flow in a first direction and a second direction opposite to the first direction.

3. The device of claim 1, such that:

the plurality of magnets are positioned so that the like poles of the plurality of magnets are adjacent each other.

4. The device of claim 1, such that:

the plurality of magnets are positioned so that the like poles of a majority of the plurality of magnets are adjacent each other.

5. The device of claim 1, further comprising:

a substantially elliptical frame.

6. The device of claim 1, such that the length of electrically conducting material wound about the frame in a direction generally perpendicular to the longitudinal axis of each of the plurality of magnets, further comprises:

a plurality of coils, each of which overlies the interior channel.

7. The device of claim 1, further comprising:

a cover removably attached to the frame to shield the coil.

8. The device of claim 7, further comprising:

a cooperating cover and frame sized to establish a passage between the coil and the cover.

9. The device of claim 8, further comprising:

at least one duct to enable gaseous flow into and out of the passage from a location outside of the passage.

10. The device of claim 2, such that:

the switch is a double pole double throw switch.

11. The device of claim 1, such that:

the plurality of magnets form a continuous uninterrupted belt of magnets.

12. The device of claim 1, such that:

the plurality of magnets form a belt of magnets having at least one gap in the belt.

13. The device of claim 1, such that the frame further comprises:

a plurality of spaced apart frame portions.

14. The device of claim 1, such that the frame is further comprised of:

a non-metallic material.

15. A complex magnetic field generating device, comprising:

a frame having an open interior channel;

a plurality of magnets each of which is capable of producing a magnetic field comprised of a plurality of magnetic flux lines, wherein each of the plurality of magnets has a north pole, a south pole and a longitudinal axis passing through the north pole and south pole wherein the lines of magnetic flux of any of the plurality of magnets extends and communicates between the north and south poles, the plurality of magnets are positioned in a side by side orientation and are partially held in place by the frame to surround the interior channel so that the longitudinal axes associated with at least two of the plurality of magnets are parallel with one another;

a source of electrical energy for supplying an electrical current to a coil means, wherein the coil means is formed from a length of electrically conducting wire wrapped about the plurality of magnets and generally perpendicular to the orientation of the longitudinal axis of each of the plurality of magnets enabling the lines of magnetic flux to surround the length of electrically conducting material and be parallel to the lines of magnetic flux associated with each of the plurality of magnets.

16. The device of claim 15, further:

a switch to enable the electrical current to flow in a first direction and a second direction opposite to the first direction.

17. The device of claim 15, such that:

the plurality of magnets are oriented so that the like poles of the plurality of magnets are positioned adjacent each other.

18. The device of claim 15, such that:

the plurality of magnets are oriented so that the like poles of a majority of the plurality of magnets are positioned adjacent each other.

19. The device of claim 15, further comprising:

a substantially elliptical frame.

20. The device of claim 15, such that the coil means, further comprises:

a plurality of coils.

21. The device of claim 15, further comprising:

a cover removably attached to the frame to shield the coil means.

22. The device of claim 21, further comprising:

a cooperating cover and frame sized to establish a passage between the coil means and the cover.

23. The device of claim 22, further comprising:

at least one duct to enable gaseous flow into and out of the passage from a location outside of the passage.

24. The device of claim 16, such that:

the switch is a double pole double throw switch.

25. The device of claim 15, such that:

the plurality of magnets form a continuous uninterrupted belt of magnets.

26. The device of claim 15, such that:

the plurality of magnets form a belt of magnets having at least one gap in the belt.

27. A complex magnetic field generating device, comprising:

a plurality of magnets wherein each of the plurality of magnets is capable of producing a magnetic field comprised of numerous lines of magnetic flux, wherein each of the plurality of magnets has a north pole and a south pole and a longitudinal axis passing through the north and south poles, frame means for holding the plurality of magnets in an axis parallel orientation such that the longitudinal axes of at least two of the plurality of magnets are parallel with one another wherein the frame means further includes an interior channel;

a coil of electrically conducting wire having a length that is wrapped about the frame to overlie the interior channel and be located adjacent to the plurality of magnets;

a source of electrical energy for supplying an electrical current to the length of wire forming the coil enabling a magnetic field comprised of circular magnetic flux lines to surround the wire such that the wire is at the center of the circular magnetic flux lines when the electrical current is supplied; and wherein the circular lines of magnetic flux are generally parallel with respect to the lines of magnetic flux associated with each of the plurality of magnets.

28. The device of claim 27, further:

a switch to enable the electrical current to flow in a first direction and a second direction opposite to the first direction.

29. The device of claim 27, such that:

the plurality of magnets are oriented so that the like poles of the plurality of magnets are positioned adjacent each other.

30. The device of claim 27, such that:

the plurality of magnets are oriented so that the like poles of a majority of the plurality of magnets are positioned adjacent each other.

31. The device of claim 27, such that the frame means further comprises:

a substantially elliptical shape.

32. The device of claim 27, such that the coil of electrically conducting material wrapped about the plurality of magnets and orthogonal to the longitudinal axis of each of the plurality of magnets, further comprises:

a plurality of coils.

33. The device of claim 27, further comprising:

a cover removably attached to the frame means to shield the coil.

34. The device of claim 33, further comprising:

a cooperating cover and frame means sized to establish a passage between the coil and the cover.

35. The device of claim 34, further comprising:

at least one duct to enable gaseous flow into and out of the passage from a location outside of the passage.

36. The device of claim 28, such that:

the switch is a double pole double throw switch.

37. The device of claim 27, such that:

the plurality of magnets form a continuous uninterrupted belt of magnets.

38. The device of claim 27, such that:

the plurality of magnets form a belt of magnets having at least one gap in the belt.

* * * * *